US006381894B1

(12) United States Patent
Murphy

(10) Patent No.: US 6,381,894 B1
(45) Date of Patent: May 7, 2002

(54) BOLA LAUNCHER

(75) Inventor: John P. Murphy, Severna Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 39 days.

(21) Appl. No.: 09/649,607

(22) Filed: Aug. 29, 2000

(51) Int. Cl.[7] ..... F41A 21/00
(52) U.S. Cl. ..... 42/77; 42/90
(58) Field of Search ..... 42/76.01, 77, 90

(56) References Cited

U.S. PATENT DOCUMENTS

| | | | | | |
|---|---|---|---|---|---|
| 34,626 | A | | 3/1862 | Ely | |
| 34,628 | A | | 3/1862 | Gault | |
| 35,734 | A | | 6/1862 | Gault | |
| 39,282 | A | | 7/1863 | Ganster | |
| 1,151,070 | A | | 8/1915 | Victory | |
| 1,229,421 | A | | 6/1917 | Downs | |
| 1,276,689 | A | * | 8/1918 | Poudrier | |
| 1,304,857 | A | | 5/1919 | Davis | |
| 3,717,348 | A | * | 2/1973 | Bowers | 273/96 |
| 3,831,306 | A | * | 8/1974 | Gregg | 42/79 |
| 4,559,737 | A | | 12/1985 | Washington | 43/59 |
| 4,750,692 | A | * | 6/1988 | Howard | 244/158 |
| 4,912,869 | A | * | 4/1990 | Govett | 42/105 |
| 5,326,101 | A | | 7/1994 | Fay | 273/84 R |
| 5,460,155 | A | * | 10/1995 | Hobbs, II | 124/56 |
| 5,561,263 | A | * | 10/1996 | Baillod | 102/504 |
| 5,698,815 | A | | 12/1997 | Ragner | 102/502 |
| 5,706,795 | A | * | 1/1998 | Gerwig | 124/71 |
| 5,750,918 | A | | 5/1998 | Mangolds et al. | 102/502 |
| 5,814,753 | A | | 9/1998 | Rieger | 89/1.11 |
| 5,831,199 | A | | 11/1998 | McNulty, Jr. et al. | 89/1.11 |
| 5,898,125 | A | | 4/1999 | Mangolds et al. | 102/439 |

* cited by examiner

*Primary Examiner*—Michael J. Carone
*Assistant Examiner*—Denise J Buckley
(74) *Attorney, Agent, or Firm*—Mark Homer

(57) ABSTRACT

A bola deployment device for launching a bola from a firearm has a housing member, a plurality of tubular segments with pockets for inserting a bola weight and a stowage area for placing the bola cord. The bola deployment device is attached to the end of a firearm and when fired, the weighted ends of the bola effectively separate from each other as the bola departs from the bola deployment device.

19 Claims, 1 Drawing Sheet

BOLA LAUNCHER

The invention described herein may be manufactured and used by or for the government of the United States of America for governmental purposes without the payment of any royalties thereon or therefor.

BACKGROUND OF THE INVENTION

1. Field of the Invention

The present invention relates to non-lethal ensnarement devices. More particularly, the non-lethal ensnarement devices of the present invention include a bola mechanism for capturing fleeing persons. Most particularly, the bola mechanism of the present invention may be used in standard firearms used by military and police forces.

2. Brief Description of the Related Art

Bolo shotgun rounds are commercially available. One type of bolo shotgun round contains 3 rubber balls connected by cord. These rounds are fired from a standard 12 gauge shotgun. Problematic with this type of round is that the 3 rubber balls have a tendency to fly together until they impact the object, thereby minimizing the bolo effect, i.e., wrapping around the target. One attempt to overcome this problem is found in U.S. Pat. No. 4,559,737 to Washington. The Washington patent discloses a specialized firearm snare device having a Y-shaped member for receiving a pair of projectiles connected by a flexible line. The firearm provides divergent barrels to separate the bola device on firing. As such, Washington requires the specialized firearm configurations for proper functioning of the bola device for dispersing two parts of a bola away from each other.

In view of the foregoing, there is a need for an improved bola launcher that provides reliable bola deployment when fired from standard firearms. The present invention addresses this and other needs.

SUMMARY OF THE INVENTION

The present invention includes a bola deployment device for launching a bola from a firearm comprising a housing member forming a chamber therein, a plurality of tubular segments forming hollow cylinders therethough between a first and second end, the tubular segments attached to the housing member at the first end forming an open conduit between the hollow cylinders and housing member chamber, the second end forming an open conduit with the outside of the tubular segment, wherein the housing member provides an angular separation of the tubular segments and means for stowing connecting cords.

The present invention also includes a method for launching a bola device from a firearm comprising the steps of providing a bola deployment device for launching a bola from a firearm comprising a housing member forming a chamber therein, a plurality of tubular segments forming hollow cylinders therethough between a first and second end, the tubular segments attached to the housing member at the first end forming an open conduit between the hollow cylinders and housing member chamber, the second end forming an open conduit with the outside of the tubular segment, wherein the housing member provides an angular separation of the tubular segments and means for stowing connecting cords, attaching the housing member onto the end of the firearm, combining a bola having a plurality of weighted ends connected by cord to the bola deployment device, wherein each weighted end is inserted into the second end of one of the tubular segments and the cord is stowed by the means for stowing connecting cords and firing a blank charge from the firearm, wherein the force of the blank charge transits through the housing member and forces the bola out of the tubular segments, causing the weighted ends of the bola to effectively separate from one another prior to target contact.

Additionally, the present invention includes a deployed bola product produced by the process comprising the steps of providing a bola deployment device for launching a bola from a firearm comprising a housing member forming a chamber therein, a plurality of tubular segments forming hollow cylinders therethough between a first and second end, the tubular segments attached to the housing member at the first end forming an open conduit between the hollow cylinders and housing member chamber, the second end forming an open conduit with the outside of the tubular segment, wherein the housing member provides an angular separation of the tubular segments and means for stowing connecting cords, attaching the housing member onto the end of the firearm, combining a bola having a plurality of weighted ends connected by cord to the bola deployment device, wherein each weighted end is inserted into the second end of one of the tubular segments and the cord is stowed by the means for stowing connecting cords and firing a blank charge from the firearm, wherein the force of the blank charge transits through the housing member and forces the bola out of the tubular segments, causing the weighed ends of the bola to effectively separate from one another prior to target contact, wherein contact with the target results in an entangled object with the bola.

DETAILED DESCRIPTION OF THE PREFERRED EMBODIMENT

The present invention provides a bola launcher useful in separating a bola fired from a standard firearm. The bola launcher is attached to the end of a barrel of a firearm, such as a shotgun, and loaded with a bola prior to firing. The bola launcher provides law enforcement and military personnel the ability to quickly capture a fleeting suspect using non-lethal force. Rather than chasing down a fleeing suspect, the bola is fired by the police or military member to trip and/or knock down the suspect. The present invention is particularly useful in urban police operations or military peace-keeping missions.

Figure 1:
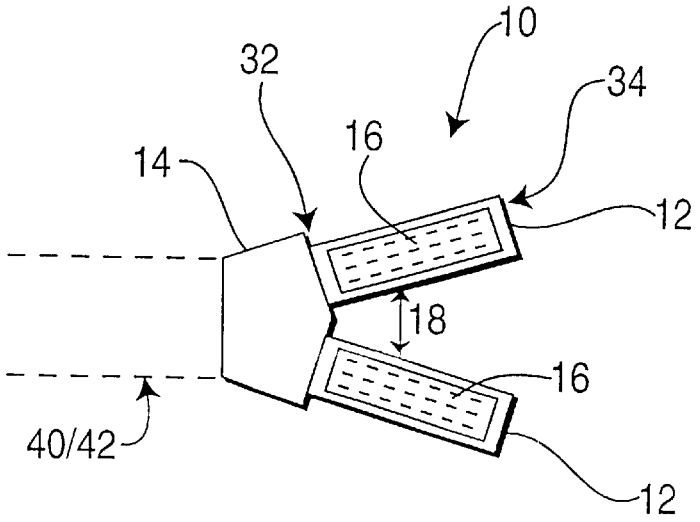
FIG. 1 illustrates the bola launcher of the present invention.

As seen in FIG. 1, a bola deployment device 100 of the present invention includes a bola launcher 10 comprising a singular housing member 14 and multiple tubes or tubular segments 12 connected to the housing member 14. The bola deployment device 10 is appropriately dimensioned for insertion onto a firearm 40, with the dimensions for a given firearm determinable by those skilled in the art in light of the disclosure herein. The housing member 14 is connected to the barrel 42 of a Remington Model 870 shotgun (having a 26 inch Rem-Choke barrel, with a Hastings REM 12640 Choke Tube installed onto the end of the barrel), by means of mating threads machined on the outside diameter of the choke tube and the inside of the housing member 14. Typically the firearm 40 comprises a shotgun or other similar device, such as a 12 gauge, 20 gauge or the like, shotgun.

The housing member 14 is configured to fix to the end of the firearm 40, allowing the force of the firing to impart equal force to each tubular segment 12. The housing member 14 comprises a resilient composition for withstanding the force of expulsion from the firearm 40, such as reinforced hardened plastic, metal and other like compositions suitable for the purposes described herein, with the proper selection of housing member 14 determinable by those skilled in the art. Preferably the housing member 14 comprises a steel composition. The diameter of the housing member 14 substantially encloses the end of the barrel 42 of the firing firearm 40 to ensure proper ejection of a bola from inside of the bola launcher 10 on firing.

The plurality of tubular segments 12 form an open conduit between the housing member 14 and the outside. Preferably, each tubular segment 12 forms a single hollow cylindrical chamber for insertion of a single weighted end of a bola. The tubular segments 12 have a second end 34 that forms an open communication between the hollow cylinder herein and the outside of the tubular segment 12, and a first end 32 that is connected to the housing member 14, forming an open conduit therebetween. The hollow cylinder within the tubular segment 12 has sufficient size and diameter to contain a weighted end of a given bola, while permitting the contained weighted end to exit from the hollow cylinder with the firing of the bola launcher 10. The first open end 32 and second end 34 are attached to the housing member 14 in a manner that provides an angular separation 18 of the tubular segments 12. Preferably , this angular separation 18 comprises an angle of from about 35° or less, more preferably from about 30° to about 15°, and most preferably from about 25° to about 20°. This angular separation 18 permits proper bola deployment from the bola launcher 10 and separation of the weighted ends of the bola after firing and prior to target contact.

The plurality of tubular segments 12 comprise a resilient composition for withstanding the force of expulsion of the bola from a firearm, such as reinforced hardened plastic, metal and other like compositions suitable for the purposes described herein, with the proper selection of tubular segments 12 determinable by those skilled in the art. Preferably the tubular segments 12 comprise a steel composition. The plurality of tubular segments 12 comprises any functional number of segments, preferably from about 3 segments or less, and more preferably 2 segments, with the number of segments 12 generally dictated by the number of weighted ends of the bola concurrently used. The length of each tubular segment 12 comprises a length appropriate for a given firearm 40, preferably from about six inches to about twelve inches in length.

The means for stowing connecting cords 16 comprises an appropriate chamber or adhesive area for holding the bola cord prior to firing. This simplifies the loading and safety of the device with the bola cord positioned adjacent to the bola launcher 10. Preferably the means for stowing connecting cords 16 comprises storage chambers fixed to the sides of the tubular segments 12, such a rope stowage packs formed along the sides of the tubular segments 12. Preferably, the rope stowage packs 16 include two rectangular pieces of nylon fabric that are sewn together with parallel lines of stitching, thereby forming tunnels between the two layers of fabric. Placement of the rope stowage packs 16, attached to the outside of the tubular segments 12, is shown in FIG. 1. The rope packs 16 may be fixed with an appropriate glue or adhesive. Preferably the storage chambers extend along the length of the tubular segments 12 which permits "payout" of the bola cord in an axial direction with the movement of the weighted ends of the bola. Preferably, the storage packs 16 comprise a flexible composition such as textile, fabric, plastic and combinations thereof, with a composition of nylon fabric being most preferred.

Figure 2:
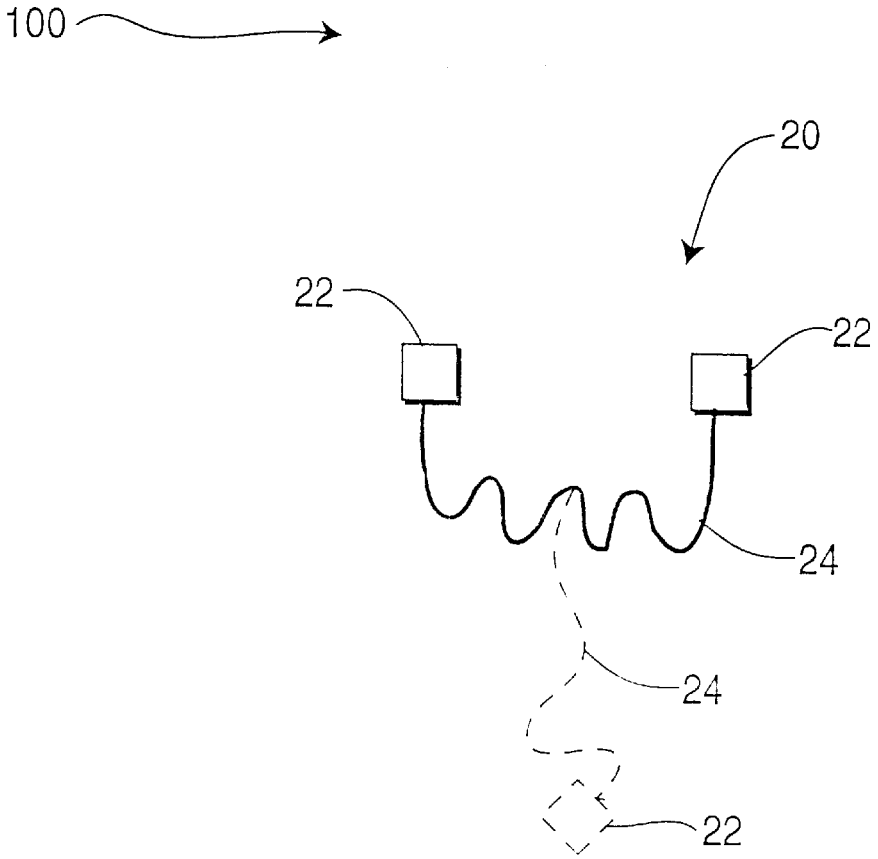
FIG. 2 illustrates a typical bola useful as a component of the present invention.

As seen in FIG. 2, the bola deployment device 100 further includes a bola 20 having multiple weighted ends 22 connected by a cord 24. The weighted ends 22 preferably are covered with an elastic composition to minimize injury, such as a material of rubber, plastic, fabric or other like soft composition, with the proper material selection determinable by those skilled in the art. Examples of weighted ends 22 include, without limitation, fabric bags with sand, rubber balls, plastic balls, and the like.

The connecting cord 24 of the bola 20 preferably comprises a filament, wire, rope, fabric or other like connecting material. The length of the cord 24 may include any appropriate length for a given purpose, with the proper length determinable by those skilled in the art. Preferred lengths of the cords 24 range from about six feet to about twelve feet between weighted ends 22.

In operation, the above described bola launcher 10 is attached or connected onto the end of a firearm with the housing member 14 connected to the end of the barrel 42 of the firearm 40. The tubular segments 12 are horizontally level with the ground, or in the case of greater than two tubular segments 12, the third tubular segment 12 may comprise some degree of vertical displacement. The bola 20 is loaded into the tubular segments 12 by placing each weighted end 22 of the bola 20 into the second end 34 of the tubular segments 12, i.e., one weighted end 22 per tubular segment 12. The cord 24 is placed inside of the rope packs 16, preferably in equal amounts. A blank charge is loaded into the firearm, and the firearm is then fired. Upon firing the shotgun, the pressure generated by firing the blank shotgun shell propels each of the weighted ends 22 from the tubular segments 12. After the weighted ends 22 exit the tubular segments 12, the cord 24 pays out of the rope storage packs 16. Due the included angle 18 between the tubular segments 12, the bola 20 stretches out to its full cord length as it approaches the target. Upon impact, the bola 20 wraps around the target. Additionally, the bola 20 expands in the horizontal plane, parallel to the ground, providing an effective tripping/knocking down motion of the bola 20 to a suspect. The angular separation 18 of the bola launcher 10 separates the weighted ends 22 of the bola 20 until the bola 20 contacts a target. The bola 20 may be loaded into the bola launcher 10 after the bola launcher 10 has been placed on the firearm, or pre-loaded into the bola launcher 10 prior to placement on the firearm. This firing mechanism of the bola 20 does not rely on random aerodynamic forces to expand the bola, which affect vertical expansion as well as horizontal expansion.

The blank charge contains sufficient force to propel the bola 20 from the bola launcher 10 an effective distance to entangle a fleeing suspect. An effective distance includes engagement distances known to police or military personnel, generally within the range of 100 feet or less, with distances of 50 feet or less. 25 feet or less, etc., useful for the implementation of the present invention. The implementation of the bola deployment device 100 produces an entangled object, usually a fleeing person. The object may include other desirable targets, such as a wild animal marauding in a residential area and the like.

EXAMPLE

A blank shotgun shell, having 23 grams of Bullseye powder, Federal No. 209 primer, and six ¼ inch felt wads crimped into a Winchester AA 2.75 inch shotshell was loaded into a Remington Model 870, 12 gauge shotgun. The housing was approximately 2 inches long with two tubular segments, each 12 inches long. A hole having a diameter of approximately 1.4 inches extended through the tubular segments. Along the sides of the two tubular segments, rope stowage packs were fixed with velcro. Adhesive backed hook velcro was attached to the two tubular segments and loop velcro was sewn to the rope stowage packs. The rope stowage packs were made of two rectangular pieces of nylon fabric that are sewn together with parallel lines of stitching and extended the length of the tubular segments. A bola having weighted ends of sand filled bags made from Kevlar cloth, each weighing 95 grams, with a cord made of Kevlar that extended approximately 10 feet, was used. The weighted ends were inserted into the ends of the tubular segments and the cord was placed in equal amounts (about 5 feet each) into each of the rope stowage packs. The firearm was aimed at a target of two 2×4 wooden framing studs planted in the ground approximately 2 feet apart. The firearm was fired at a range of approximately 25 feet. The muzzle exit velocity of the bola was approximately 170 ft/sec. Four bolas were tested, with each test resulting in the bola entangling both the wooden framing studs.

The foregoing summary, description, example and drawings of the invention are not intended to be limiting, but are only exemplary of the inventive features which are defined in the claims.

What is claimed is:

1. A bola deployment device for launching a bola from a firearm, comprising:

a housing member forming a chamber therein;

a plurality of tubular segments forming hollow cylinders therethrough between a first and second end, the tubular segments attached to the housing member at the first end forming an open conduit between the hollow cylinders and housing member chamber, the second end forming an open conduit with the outside of the tubular segment wherein the housing member provides an angular separation of the tubular segments; and, means for stowing connecting cords comprising storage chambers fixed to the sides of the tubular segments.

2. The bola deployment device of claim 1, wherein the housing member comprises a resilient composition.

3. The bola deployment device of claim 1, wherein the housing member comprises a steel composition.

4. The bola deployment device of claim 1, wherein the plurality of tubular segments comprise a resilient composition.

5. The bola deployment device of claim 1, wherein the plurality of tubular segments comprise a steel composition.

6. The bola deployment device of claim 1, wherein the plurality of tubular segments comprises from about 3 or less segments.

7. The bola deployment device of claim 6, wherein the plurality of tubular segments comprises approximately 2 segments.

8. The bola deployment device of claim 1, wherein each tubular segment comprises a length of from about six inches to about twelve inches.

9. The bola deployment device of claim 7, wherein the storage chambers extend along the length of the tubular segments.

10. The bola deployment device of claim 1, further comprising a bola comprising weighted ends having a covering selected from the group consisting of rubber, plastic and fabric.

11. The bola deployment device of claim 10, wherein the weighted ends comprise rubber balls.

12. The bola deployment device of claim 1, further comprising a bola having connecting cords selected from the group consisting of filaments, wire, rope, and fabric.

13. The bola deployment device of claim 1, further comprising a bola having connecting cords with a length of from about six feet to about twelve feet between weighted ends.

14. A shotgun comprising the bola deployment device of claim 1.

15. A method for launching a bola device from a firearm, comprising the steps of:

providing a bola deployment device for launching a bola from a firearm comprising a housing member forming a chamber therein, a plurality of tubular segments forming hollow cylinders therethough between a first and second end, the tubular segments attached to the housing member at the first end forming an open conduit between the hollow cylinders and housing member chamber, the second end forming an open conduit with the outside of the tubular segment, wherein the housing member provides an angular separation of the tubular segments and means for stowing connecting cords comprising storage chambers fixed to the sides of the tubular segments;

attaching the housing member onto the end of the firearm;

combining a bola having a plurality of weighted ends connected by cord to the bola deployment device, wherein each weighted end is inserted into the second end of one of the tubular segments and the cord is stowed by the means for stowing connecting cords; and, firing a blank charge from the firearm, wherein the force of the blank charge transits through the housing member and forces the bola out of the tubular segments, causing the weighted ends of the bola to effectively separate from one another prior to target contact.

16. The method of claim 15, wherein the length of cords is stored proportionately among the plurality of tubular segments within the means for stowing connecting cords.

17. A deployed bola product produced by the process comprising the steps of:

providing a bola deployment device for launching a bola from a firearm comprising a housing member forming a chamber therein, a plurality of tubular segments forming hollow cylinders therethough between a first and second end, the tubular segments attached to the housing member at the first end forming an open conduit between the hollow cylinders and housing member chamber, the second end forming an open conduit with the outside of the tubular segment, wherein the housing member provides an angular separation of the tubular segments and means for stowing connecting cords comprising storage chambers fixed to the sides of the tubular segments;

attaching the housing member onto the end of the firearm;

combining a bola having a plurality of weighted ends connected by cord to the bola deployment device, wherein each weighted end is inserted into the second end of one of the tubular segments and the cord is stowed by the means for stowing connecting cords; and, firing a blank charge from the firearm, wherein the force of the blank charge transits through the housing member and forces the bola out of the tubular segments, causing the weighted ends of the bola to effectively separate from one another prior to target contact, wherein contact with the target results in an entangled object with the bola.

18. The deployed bola product of claim 17, wherein the bola comprises two weighted ends.

19. The deployed bola product of claim 17, wherein the bola comprises three weighted ends.

* * * * *